US005404900A

United States Patent [19]

Fletchall

[11] Patent Number: 5,404,900

[45] Date of Patent: Apr. 11, 1995

[54] SUPER REEL

[76] Inventor: Allen H. Fletchall, 2728 Leisure World, Mesa, Ariz. 85206

[21] Appl. No.: 959,124

[22] Filed: Nov. 16, 1992

[51] Int. Cl.[6] ..... B65H 75/34

[52] U.S.Cl. ..... 137/355.27; 137/355.19

[58] Field of Search ..... 137/355.19, 355.26, 137/355.27

[56] References Cited

U.S. PATENT DOCUMENTS

| | | | |
|---|---|---|---|
| 561,229 | 6/1896 | Kern et al. | 137/355.19 |
| 720,228 | 2/1903 | Couch | 137/355.19 |
| 3,939,862 | 2/1976 | Booth | 137/355.19 |
| 4,979,693 | 12/1990 | Eberhardt et al. | 137/355.19 |

*Primary Examiner*—A. Michael Chambers

[57] ABSTRACT

A hose reel is disclosed for domestic or industrial use. An apparatus is disclosed for winding a hose or storing a garden hose or elongated material. A more automatic and practical means of handling elongated material in a secured manner. One feature of the apparatus is the automatic leveling of the reel.

All components of the reel can be made in two piece molds for easier and less expensive manufacturing. The hose will have a water shutoff apparatus on the inner end of the hose which will be pressure operated and will let the user turn the water off at the outer end long enough to take the nozzle off, then walk to turn the main faucet off and reel the hose in and not having to walk the distance of the hose, turn the water off, walk back to take off the nozzle. The water may be turned on and off at the outer end of the hose.

The lid lifters can be made of automotive tailgate lifters.

1 Claim, 6 Drawing Sheets

SUPER REEL

FIELD OF INVENTION

This invention relates to hose reels.

DESCRIPTION OF PRIOR ART

In 1896 M. H. Kern and H. Tideman were granted a patent on their invention for the convenience of the public. In 1976 William M. Booth was granted a patent. These apparatuses are antiquated by the standard reel of today, sighting as an example Sears Craftsman with a manual sliding leveling handle that takes two hands to operate and is subject to breaking when pressure is applied while reeling hose from the side as some users do. The manual leveling and the side pressure breaking both can be eliminated in the engineering of this new art. Prior art had the water shut off valves built in their reels. The new art will feature a water off-on control at the inner end of the hose. (note this control is not included in this invention).

SUMMARY OF INVENTION

The super reel of this invention does not include a helical drum which required extra material and labor to manufacture.

BRIEF DESCRIPTION OF THE DRAWINGS

Note;All right or left directions are based on looking forward from the behind the reel.

FIG. 3. Shows mainly the turning handle and the ratchet plate with receiving holes discussed later.

FIG., 5, 5A, 5B. Show one of the main features of the invention; the hose carrying block, the block carries the hose across the front of the reel spool.

Figure 6:
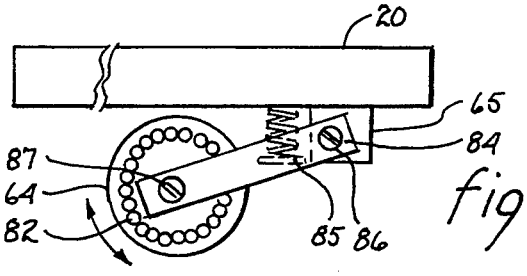

FIG. 6. Is the hose placement roller that keeps the hose in the proper place when it is rolled on the reel.

FIG. 7. Locates the carrying block with the swiveling assembly body in its midst. The swiveling body components are shown in FIG. 5*a* and 5*b*.

Figure 8:
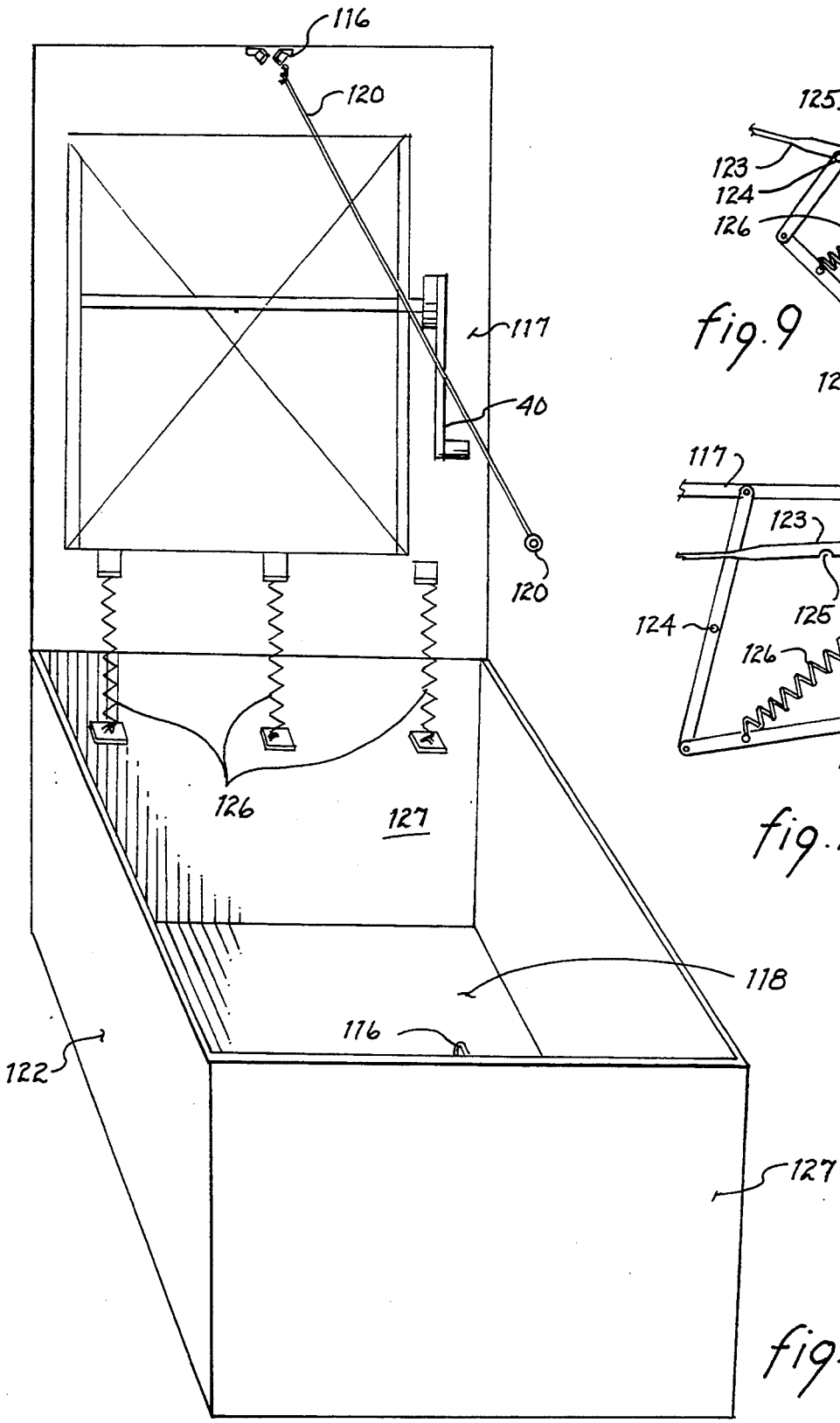

FIG. 8. is a view of how the reel is stored in the vault.

Figure 9:
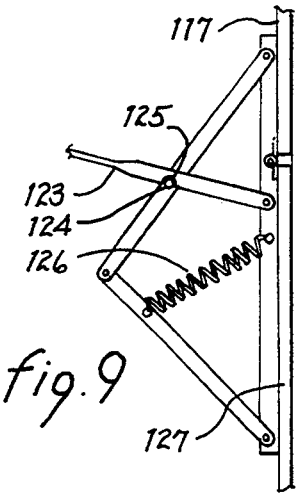
Figure 10:
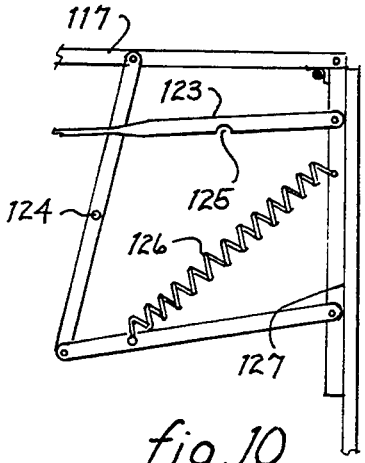

FIGS. 9 and 10 show an embodiment of spring loaded hinges.

Figure 11:
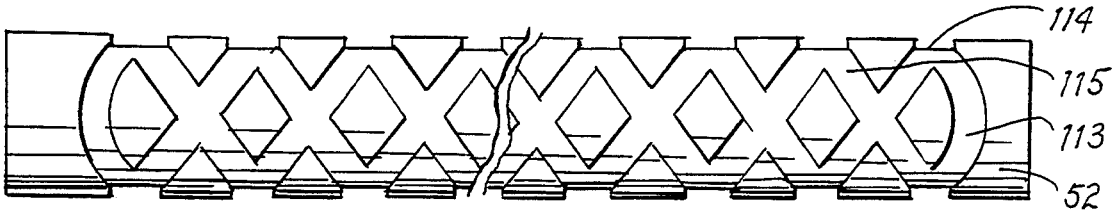

FIG. 11. The leveling shaft is another new feature of the reel, it supports the carrying block as it transverses.

Figure 12:
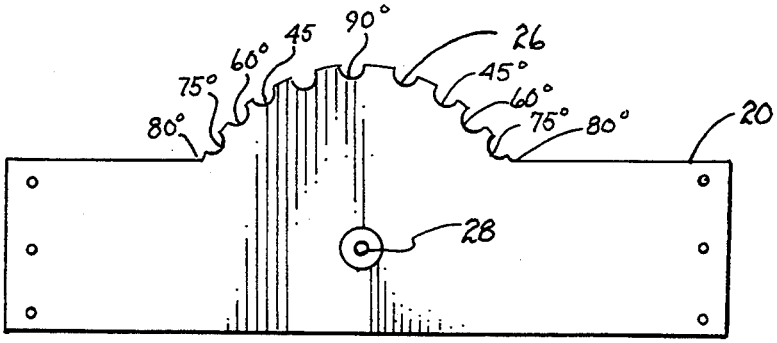

FIG. 12. Is the cross plate that has the degree of angle notches fastened to the front of it.

Figure 13:
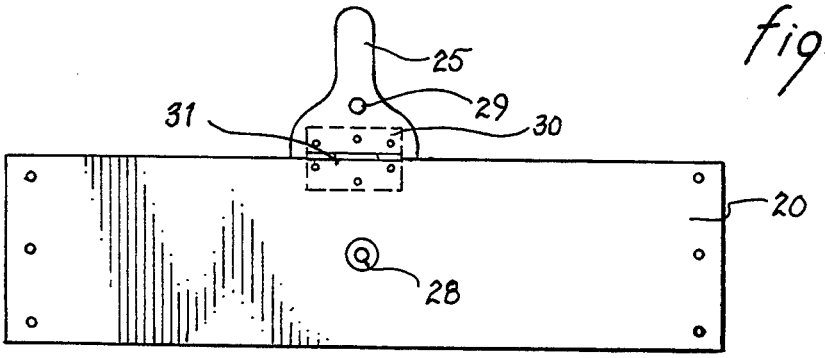

FIG. 13. The cross plate immediately under the cross plate holding the degree of angle notches holds the degree of angle handle with a stud on the bottom side that catches in the notches.

Figure 14:
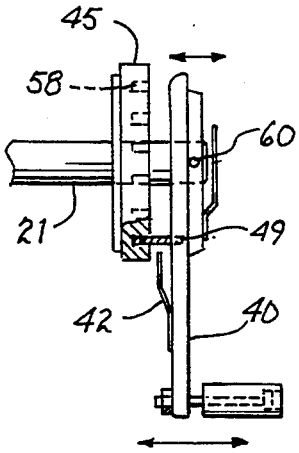

FIG. 14. Is a close up drawing of the turning handle and ratchet plate.

Figure 15:
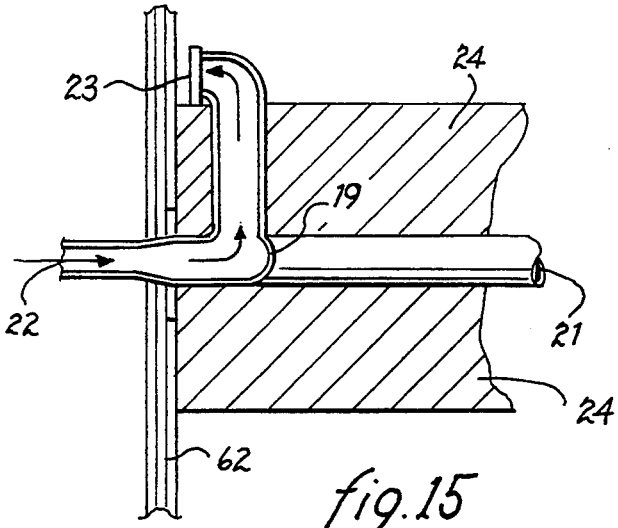

FIG. 15. Shows a view of the right end of the main shaft with the water inlet and outlet at the end.

Figure 16:
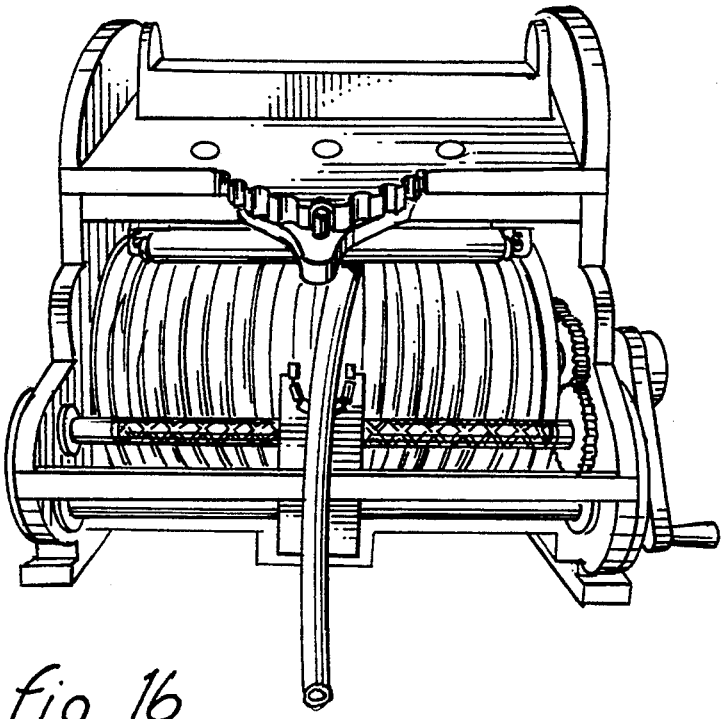
Figure 17:
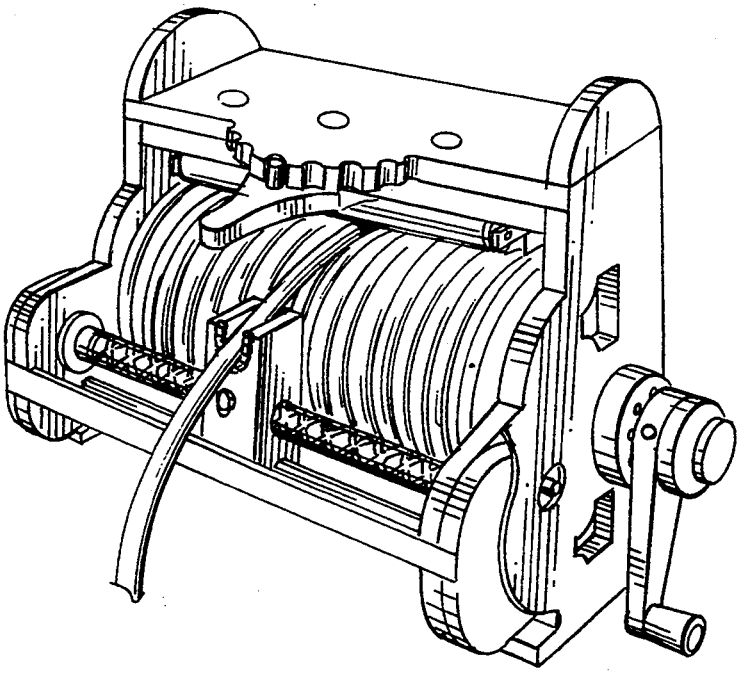

FIG. 16. and 17. are photos taken of the full operational prototype reel.

DESCRIPTION OF THE PREFERRED EMBODIMENT

Detailed description of the preferred embodiment shown in seventeen drawings and photographs. The numbered components are described in the embodiment analysis.

Statements using left or right direction is determined by looking forward from the rear of the reel.

Figure 1:
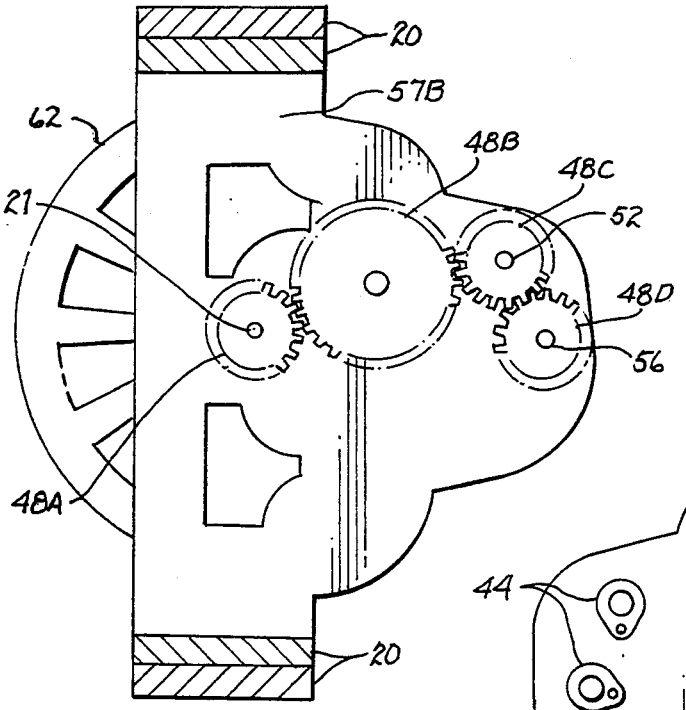
FIG. 1. This view of the reel shows the left side of the reel and the location of the gear assembly.

FIG. 1. Shows an inside view of left frame upright **57*b*,P-1 holding the gear assembly 48*a*, 48*b*, 48*c* and 48*d* of the apparatus that delivers energy to rotate the reel spool core 24 FIG. 4,15,P-2-5 which the elongated material is wound on. The vertical frame 57*b* P-1 also holds the left end of the main shaft 21 that is encircled by the spool core 24 and of which gear 48*b* and the left end of the leveling shaft 52 and the left end of the block stabilizing shaft 56. The shaft 56 serves as an antilock up for the transversing hose carrying block 54,P-2-3 also shown in FIG. 4 P-2 and FIG. 5 and photo P-6. 57*b* is also attached to the right end of the cross plate 20 upper and lower 20 which is connected to upright frame 57*a* and 57*b*, FIG. 1,2,P1 and FIG. 3,4,P1-2**.

Figure 2:
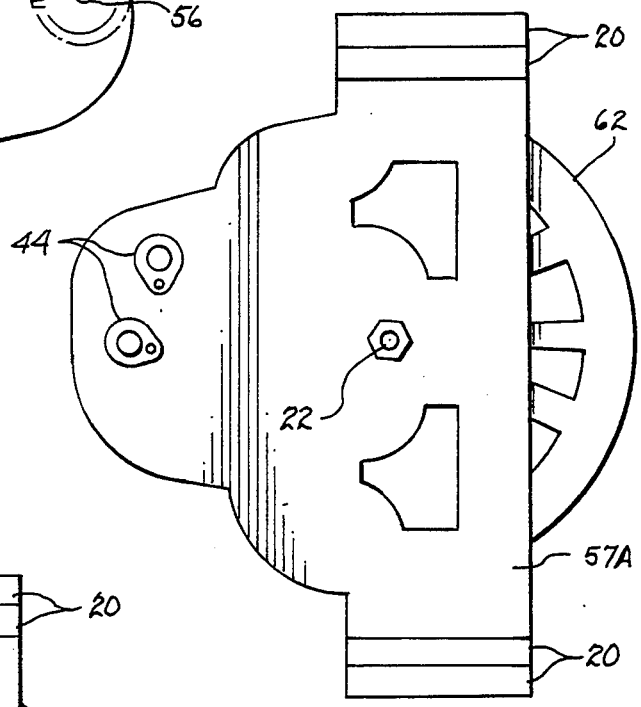
FIGS. 2 & 3. Show the right frame that holds the other ends of the shafts.

FIG. 2.P-1 Displays the outside view of the right upright frame **57*a* that holds the right end of the main shaft 21 of the spool's main shaft FIG. 2,22**.

Figure 3:
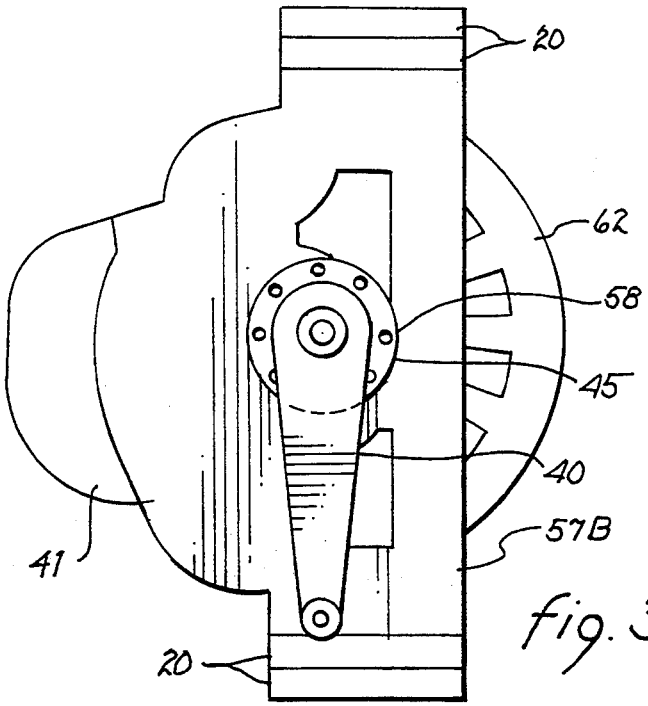

FIG. 3. Tells the position in the apparatus of the cross plates upper and lower 20 FIG. 1,2,3,4,P-1-2. The hose reel 62,24 FIG. 1,2 3,4 P-1-5. The ratchet receiving holes 58 FIG. 3-4, P1-2 and FIG. 14 P-5 houses the ratchet spur 49 FIG. 4,14,P2-5. The apparatus is best shown in FIG. 14. in the winding mode. The turning handle 40 when energy is applied toward the center of the reel and turned clockwise, engages the spur 49, FIG. 4-14,P 2-5 into the ratchet plate holes 58, FIG. 3-14 that connect and make possible the rotation of the spool. The dress plate 41 covers the outside of the shaft holes of the adjustable bearings 44. This probably will not appear in the manufactured reel.

Figure 4:
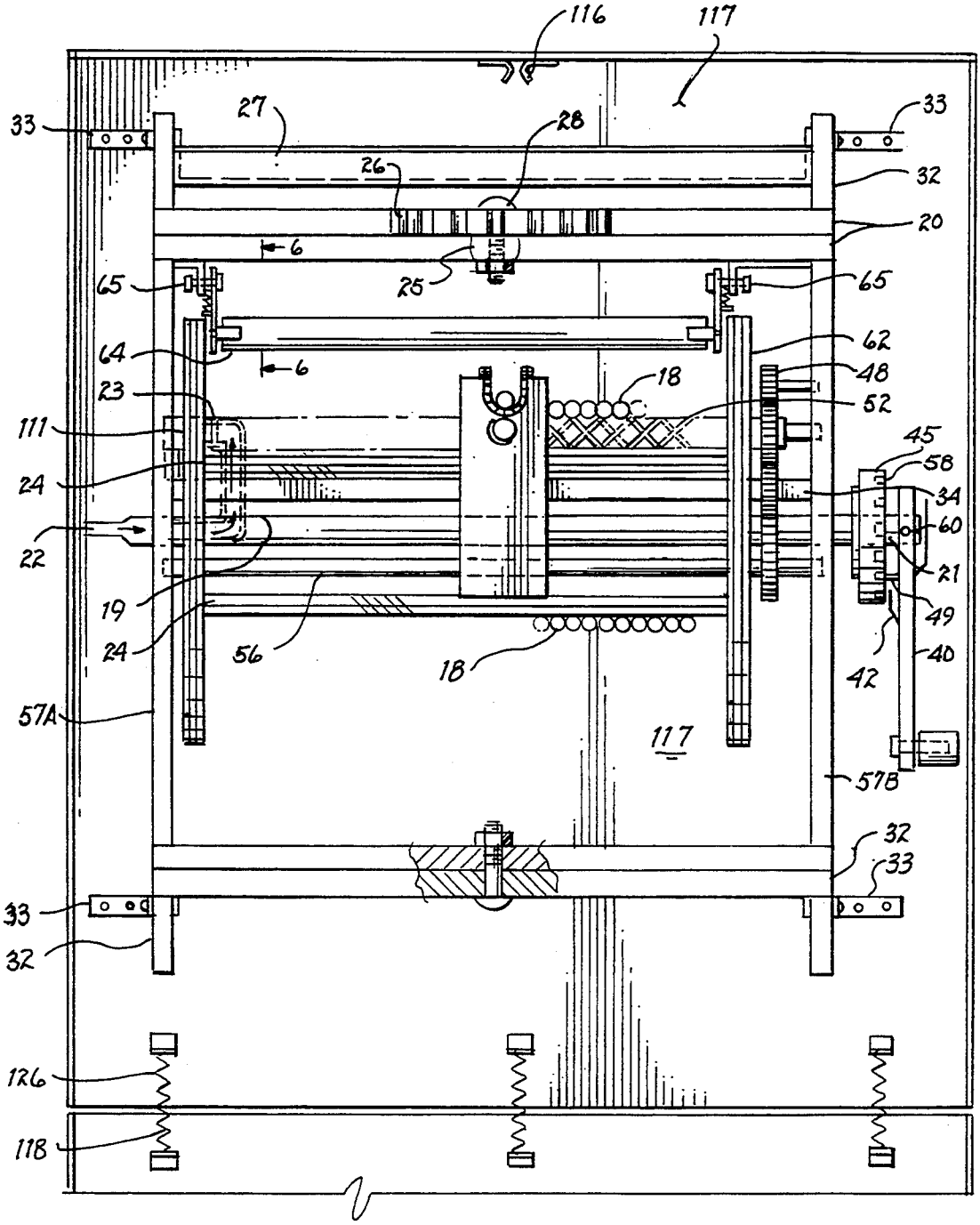
FIG. 4. Gives us a view of the whole picture of the reel.

FIG. 4. Displays the majority of the components of the apparatus of the reel and where they are located in respect to the assembly of the apparatus. Numbers not appearing in this FIG. are pictured in detail in other figures.

The nozzle tray 27 can be used for accessories, tools and etc. The swivel bolts 28 FIG. 4,P-2 FIG. 12, P-5 allows the reel to be twisted (turned) toward the direction in which the hose is lying from the reel to be reeled in. Reel anchor arms 32 anchor the reel frame to the lid 117 of the vault 118 FIG. 8, P-4. Material 18 reeled on the spool 62,24. FIG. 1-2-3 P-1 and FIG. 4. 18 P2. the main shaft 21 is made of two pieces, joined by a concave, convex joint 19 FIG. 4, P-2 is a non moving joint in the main shaft 21. The crossbrace 34 is attached at its ends to the frame **57*a* and 57*b*. FIG. 4. and photo. The turning hinge bolt 60 attaches the turning handle 40 to the main shaft 21. FIG. 4,14 P-2-5 also allows the turning handle to hinge and pull the spur 49 away from the spur receiving holes 58; thus disengaging the energy and stopping the winding process. Anchor arm braces 33 help stabilize the reel that is fastened to the arms that the braces 33** serve.

Figure 5:
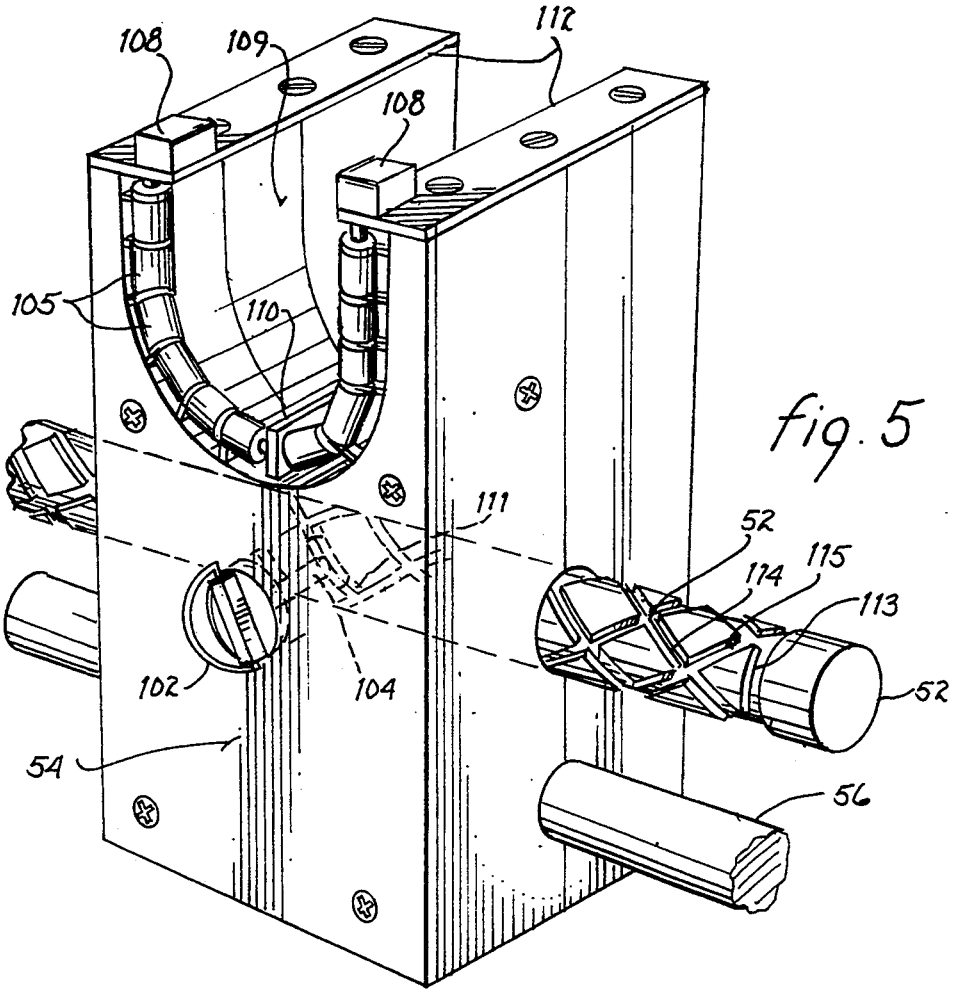
Figure 5B:
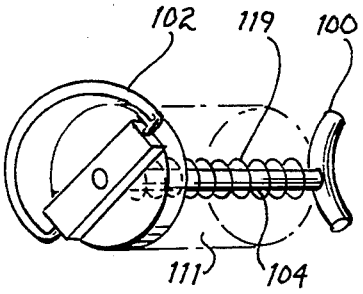
Figure 5A:
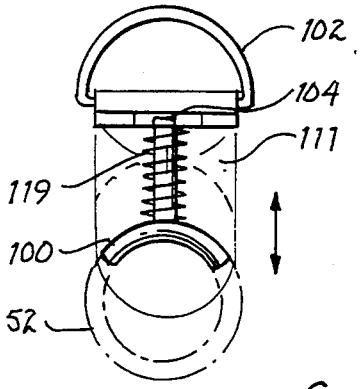

FIG. 5 P-3 Displays the carrying block 54 with hose guide anchor 108 the top and the bottom anchor 110 of the carrying block 54. The upper block connector 112 holds the two pieces of the block together at the top. Carrying block hose slot 109 FIG. 4,5 P2-3 photo photo P-6 makes a saddle like place for the hose to ride in for correct positioning to be reeled on the spool. The hose guide slot rollers 105 FIG. 5,P-3 roll when the hose is dragged over them and allows the hose to roll through the carrying block hose slot 109 with ease; hose guide rollers 105 also allow the connecting joint of two hoses to roll up and over the block so as not to damage the block and/or reel.

FIG. 6. Illustrates how the cross plates 20 supports the roller hinge bracket 65; which holds the roller hinge arm 84 of which the roller bolt 87 supports the hose holding placement roller 64 FIG. 4,6, P2-3. connected with roller hinge bolt 86. P-3 photo. The roller compression spring 85 keeps a downward pressure on the roller 64 so the reeled in hose 18 FIG. 4, P2 will stay in place. The hose holding placement roller ball bearing FIG. 6 P-3 works superbly. P-3*a* FIG. 5*b*, shows a horizontal view of the block swiveling assembly body components. FIG. 5*a* also shows components in a vertical view of the same body. Components 102 is the tab turning wing, when it is pulled out the following tab 100 is lifted out of the leveling shaft 52 and turned to the right or left and released down into the grooves of the leveling shaft 114 takes the carrying block to the right 115 goes to the left and changes the direction of travel for the carrying block. The carrying block carries the hose across the front of the spool and guiding the hose to be wound on the spool in a neat corded manner. The swiveling assembly 111 is positioned in a hole made in front of the carrying block 54 FIG. 5P-3 The transversing takes place when the shaft is rotated. The carrying block 54 will transverse across the spool without stalling. The stabilizing shaft 56 goes thru the bottom of the block 54. The stabilizing shaft keeps the block 54 so that it does not rotate with the leveling shaft 52. Shaft 56 is geared to rotate with the leveling shaft 54. Shaft 56 is an anti-stalling shaft. It rotates so the carrying block will not hang up while transversing.

FIG. 8. Shows the storage vault 118 and other components. The lid hold down latch 116 when trip wire 120 is pulled the latch 116 is released and the lid raises into operation position. The space designated as in FIG. 4. in FIG. 8. is the underside of the lid where the reel is located. The reel is attached to the underside of the lid 117. The lid is made of two thicknesses of chip board 7/16 of an inch thick and sealed with a moisture barrier. Chip board does not warp from moisture or sunshine. These materials are most appropriate for this use. The turning handle 40 is in an ideal position (height) when the vault lid is raised in a vertical position. The vault is a sturdy construction of glasscrete; made of concrete, reinforced with fiberglass which is an ideal material to be used underground. All four sides 122 and 127 are made of this material.

The hinges are shown in FIG. 10. and FIG. 9. FIG. 10. is in a closed position. FIG. 9 is in an open position; locked in position by the vertical holding latch handle 123, with the cover 125 over the holding latch bolt 124. The hinges are spring 126 loaded FIG. 8,9,10. Automotive gas loaded tailgate lifters may be used in place of springs but are more expensive. Either of them accomplish about the same results of being raised to be used and lowered to be stored. When the lid is down it is held down by the holding lock latch 116. FIG. 8, P-4.

FIG. 11. Views the helix shaped leveling shaft 52 which shows the right travel groove 114 and the left travel groove 115; on each end of the shaft 52 there is a so called turn around groove 113 that sends the carrying block 54 the other direction carrying the hose with it.

FIG. 12. Details the location of the degree of angle notches 26 from 0 degree to 80 degrees to the right or to the left. The selection of choice of degree setting to the reel keeps the side pressure off the carrying block 54 and hose guide slot 109. This puts the stress on the spool 62 where the apparatus is built to handle it. The angle selection notches are located on the second from the top cross plate 20 that joins the vertical frames 57*a* and 57*b*.

FIG. 13. The degree selection handle 25 is fastened to the cross plate 20 with a spring hinge 30. The spring on the hinge keeps pressure on the handle keeping it in its intended locked position.

FIG. 14. is a close up drawing of the turning handle 40. The ratchet plate 45 holes 58 catch the ratchet spur 49 to engage the energy from the turning handle 40 and applying it to the ratchet plate 45 which in turn transfers the energy to rotate the main shaft 21 that rotates the reel 24, 62 FIG. 1,2,3,4, P-1 and FIG. 15 P-5. The ratchet release spring 42 will hold the turning handle 40 out away from the ratchet plate spur receiving holes 58 so there will be no backspinning of the turning handle 40 when the hose is being pulled off the spool; thus making it safer for children to be around when in operation.

FIG. 15. The water inlet 22 is heavy enough to serve as the right end of the main shaft 21. The inlet 22 for water and the outlet for water are of one piece. The inlet has a tapered receiving end for a hose to be clamped on it. The outlet has a hose threaded end for the fastening of a garden hose fitting. The reel has a capacity of 200 ft. of ⅝ inch hose 18. The main shaft 21 is in two pieces and is joined together by a concave and convex non-moving joint thus forming the main shaft for the axel to the reel.

FIG. 16. and 17. are photos of a fully operational prototype of the SUPER REEL that operates wonderfully in a new concept of a hose reel. For other materials which it can be adapted to by changing the thread count on the leveling shaft or narrowing or widening the following tab.

All components can be made in two piece molds. The molds are made of high impact or tough plastics.

The reel operates as follows:

A hose which has been unwound from the core 24 extends through the slot 109, and rests on the rollers 105, of the block 54. To wind the hose back onto the core 24, the handle 40 is manipulated so that the teeth of the spur gear 49 enter the holes of the ratchet plate 58. The handle 40 is then rotated to drive the main gear 48*b* which, in turn, drives the gear 48*a* for the core 24, the gear 48*c* for the leveling shaft 52 and the gear 48*d* for the stabilizing shaft 56. Assuming that the block 54 is initially located on the left side of the reel (as seen from the front) and that the follower tab 100 of the block 54 engages the groove 114 of the leveling shaft 52, the block 54 moves to the right along the leveling shaft 52 as the handle 40 is rotated. The stabilizing shaft 56 prevents the block 54 from rotating, and rotation of the shaft 56 prevents the block 54 from hanging up on the shaft 56. The movement of the block 54 is synchronized with the rotation of the core 24 in such a manner that the block 54 shifts by a distance equal to the diameter of the hose during each revolution of the core 24. The hose is thus coiled neatly on the core 24 with adjoining convolutions of the hose contacting each other.

When the block 54 reaches the right side of the reel, a first layer of hose is deposited on the core 24. The follower tab 100 now enters the groove 113 of the leveling shaft 52 and is directed to the groove 115 thereby changing the direction of travel of the block 54. The block 54 then travels to the left along the leveling shaft 52 to deposit a second layer of hose on the core 24.

Once the hose has been completely wound onto the core 54, the lid 117 of the storage vault 118 is closed to store the hose.

When the hose is to be used again, the trip wire 120 is pulled to release the lid 117 which opens under the action of the springs 126. The handle 25 is rotated, if necessary, to turn the core 24, the leveling shaft 52 and the block 54 towards the location at which the hose is to be used. The hose is then pulled from the core 24.

I claim:

1. A reel for storing a flexible member comprising in combination: a rotatable carrier supporting the flexible member in coiled form, said carrier having a first axis of rotation; a rotatable rod-like guide having a second axis of rotation which is substantially parallel to said first axis; a translatable guide coupled to the flexible member and mounted on said rotatable guide to move axially of the rotatable guide in response to rotation of said rotatable guide, said translatable guide having a guide passage to direct the flexible member onto said carrier; and means for rotating said carrier and said rotatable guide to wind the flexible member onto said carrier, said rotatable and translatable guides being provided with cooperating elements which allow said translatable guide to move in either direction along said second axis as said carrier rotates to wind the flexible member onto said carrier to coil the flexible member in layers onto said carrier, said cooperating elements including a helical right-handed groove and a helical left-handed groove located in said rotatable guide, and a follower on said translatable guide to selectively travel along said helical right-handed groove and along said helical left-handed groove.

* * * * *